US010869511B2

(12) United States Patent
Shapiro et al.

(10) Patent No.: US 10,869,511 B2
(45) Date of Patent: Dec. 22, 2020

(54) GARMENT WITH LOCALIZED CIRCULATION BOOSTING FEATURE

(71) Applicant: EVOGENERATE, LLC, New York, NY (US)

(72) Inventors: Holly Shapiro, New York, NY (US); John Koetz, New York, NY (US)

(73) Assignee: EVOGENERATE, LLC, New York, NY (US)

( * ) Notice: Subject to any disclaimer, the term of this patent is extended or adjusted under 35 U.S.C. 154(b) by 114 days.

(21) Appl. No.: 16/262,608

(22) Filed: Jan. 30, 2019

(65) Prior Publication Data

US 2019/0159530 A1 May 30, 2019

Related U.S. Application Data

(62) Division of application No. 15/373,557, filed on Dec. 9, 2016, now Pat. No. 10,231,494.

(51) Int. Cl.

| | |
|---|---|
| ***A41D 13/002*** | (2006.01) |
| ***A41D 13/12*** | (2006.01) |
| ***A41D 31/06*** | (2019.01) |

(52) U.S. Cl.

CPC ..... *A41D 13/002* (2013.01); *A41D 13/1236* (2013.01); *A41D 31/065* (2019.02); *A41D 2400/10* (2013.01); *A41D 2400/32* (2013.01)

(58) Field of Classification Search

CPC ... A41B 1/08; A41D 1/04; A41D 1/08; A41D 3/00; A41D 13/0015; A41D 31/0016; A41D 2200/20; A41D 2400/10

USPC ..... 2/115

See application file for complete search history.

(56) References Cited

U.S. PATENT DOCUMENTS

| | | | | |
|---|---|---|---|---|
| 2,391,535 | A | 10/1944 | Zelano | |
| 2,464,380 | A | 3/1949 | Daiber | |
| 4,625,336 | A | 12/1986 | Derderian | |
| 5,469,581 | A | 11/1995 | Uthoff | |
| 5,636,380 | A * | 6/1997 | Schindler | A41D 13/005 2/69 |
| 5,792,714 | A * | 8/1998 | Schindler | A41D 13/005 442/194 |
| 6,109,338 | A | 8/2000 | Butzer | |
| 6,243,879 | B1 * | 6/2001 | Lyden | A41D 1/08 2/227 |
| 6,332,221 | B1 | 12/2001 | Gracey | |

(Continued)

FOREIGN PATENT DOCUMENTS

JP 2005248389 A * 9/2005

*Primary Examiner* — Anne M Kozak

(74) *Attorney, Agent, or Firm* — Notaro, Michalos & Zaccaria P.C.

(57) ABSTRACT

A garment for boosting circulation in areas of a user's body corresponding to the user's joints, having at least one fabric member of a size for at least partly covering at least one part of the user's body that includes at least one joint area lying over at least one joint of the user, and at least one muscle area lying over at least one muscle of the user, the fabric member being at least one of dimensioned and structured so as not to compress the part of the user's body covered by the fabric member, the fabric member having a heat insulating property at each joint area to be covered and a heat transmitting property at each muscle area to be covered, so that when the garment is worn, each joint area stays warmer than each muscle area to boost circulation in each joint area.

4 Claims, 5 Drawing Sheets

(56) References Cited

U.S. PATENT DOCUMENTS 6,996,848 B2 * 2/2006 Donaldson ..... A41D 13/1236 2/16
7,516,498 B2 * 4/2009 Torry ..... A41D 1/08 2/69
7,743,476 B2 * 6/2010 Rock ..... D04B 1/28 28/160
7,814,576 B2 * 10/2010 Nakazawa ..... A41D 13/0015 2/227
7,945,970 B2 * 5/2011 Belluye ..... A41D 1/084 2/69
8,347,415 B2 * 1/2013 Mazzarolo ..... A41D 13/02 2/227
D681,916 S * 5/2013 Tanaka ..... D2/742
D703,920 S * 5/2014 Tanaka ..... D2/738
8,769,716 B2 * 7/2014 Luscher ..... A41D 31/02 2/46
8,769,724 B2 * 7/2014 Semba ..... A41D 1/08 2/227
8,856,964 B2 10/2014 Mather
8,887,315 B2 11/2014 Boynton
9,119,707 B2 9/2015 Brown
9,125,442 B2 9/2015 Brown
9,326,554 B2 * 5/2016 Lou ..... A41D 1/08
9,345,275 B2 * 5/2016 Albin ..... A41D 1/08
2003/0041364 A1 3/2003 Donaldson
2003/0061650 A1 4/2003 Emanuel
2004/0107479 A1 * 6/2004 Dicker ..... A41D 13/0015 2/227
2005/0086721 A1 * 4/2005 Lambertz ..... A41D 27/28 2/69
2005/0204449 A1 9/2005 Baron et al.
2006/0179539 A1 8/2006 Harber
2007/0022510 A1 * 2/2007 Chapuis ..... A61F 13/10 2/69
2008/0289078 A1 11/2008 Mather
2009/0013451 A1 * 1/2009 Baxter ..... A41B 17/00 2/455
2009/0031486 A1 * 2/2009 Sokolowski ..... A41D 1/04 2/458
2010/0011479 A1 * 1/2010 Onoda ..... A41D 7/00 2/67
2011/0088137 A1 4/2011 Ayers et al.
2011/0271415 A1 * 11/2011 Torry ..... A41D 13/065 2/23
2012/0174282 A1 7/2012 Newton
2013/0000022 A1 * 1/2013 Sokolowski ..... A41D 13/002 2/455
2013/0326785 A1 12/2013 Cornacchiari et al.
2014/0243938 A1 * 8/2014 McPherson ..... A61F 7/02 607/100
2015/0196067 A1 7/2015 Blakely
2016/0120236 A1 5/2016 Critelli
2017/0325520 A1 * 11/2017 Chu ..... A61B 5/6805
2018/0042319 A1 * 2/2018 Fowler ..... A42B 1/048
2018/0279694 A1 * 10/2018 Theno ..... A41B 9/12
2019/0160651 A1 * 5/2019 Mahoney ..... A61H 3/00
2019/0246720 A1 * 8/2019 Wilkinson ..... A41H 27/00
2019/0320736 A1 * 10/2019 Gonsalves ..... A41D 1/088
2019/0335822 A1 * 11/2019 Jesch ..... D04B 1/243

* cited by examiner

GARMENT WITH LOCALIZED CIRCULATION BOOSTING FEATURE

CROSS-REFERENCE TO RELATED APPLICATION

This application is a divisional of application Ser. No. 15/373,557, filed Dec. 9, 2016, which is incorporated herein by reference.

FIELD AND BACKGROUND OF THE INVENTION

The present invention relates generally to the field of garments, and, in particular, to a garment that increases blood circulation in selected areas corresponding to a person's joints, by retaining more heat in these areas than in other areas that are also covered by the garment. The garment of the invention may be active wear, specialized clothing to enhancing physical performance and recovery of the body from fatigue or injury, base layer/underwear, outer wear, wetsuit tops, bottoms or combination, or other general or special purpose coverings for parts or all of a person's body. The invention is for men, women and children.

Modern people are experiencing greater wear and tear on joints and muscles than at other times in history. Activities involve greater physical stresses than in the past due to extensive training and overuse for example in sports, marathons, bouts of plyometric exercise, endurance and strength training, and the like. Activities of our ancestors were based on moment-to-moment life sustaining needs. They walked, built, farmed, rested when tired, and only ran when chased by natural predators, for example, by sabertooth tigers. This invention was designed to augment the evolving physical needs and wants of modern people.

As will be explained more fully later in this disclosure, the current invention originates from the realization that heat stimulates vasodilation. The vascular system of the human body is an extensive network of connected blood vessels delivering oxygen and nutrients to the body's tissues and taking away waste (e.g. carbon dioxide/waste product of aerobic respiration and lactic acid/waste product of anaerobic respiration). The circulatory (transport) system is composed of arteries/veins (high volume transport), arterioles/venules (moderate volume), capillaries (low volume). Muscles have a prodigious vascular network that supply nutrients for muscles to contract, build, repair, discard waste-carbon dioxide/lactic acid and generate heat.

Joint capsules of the body's periphery, have a substantially limited vascular network, as a result low volume circulation. The purpose of the invention is to stimulate dilation of the capillary network (increase closer to moderate volume) improving heat/circulation in and around joint capsules of the body's periphery where pathways for circulation are limited (what gloves do for hands in the cold). Increased circulation improves the flow of oxygen and nutrients to the cells and discarding of cellular waste. This effect improves mobility, performance, reduces injury and expedites regeneration (healing/recovery). Injuries related to the overuse of the joint capsule during ambulation are a common occurrence.

The human body is not designed to accommodate the physical wear and tear of modern day physical activities. The invention effectively augments our mechanical and physiological demands.

In FIG. 9 the numerals denote temperature in degrees Celsius. This drawing schematically shows that the temperature and, therefore, the blood circulation of the joint areas are far less effective then in the muscles areas. Garment technology to date has tried to solve this with sleeves and compression garments. The invention disclosed here does not use compression, which actually reduces circulation over time, but rather increases circulation and, in turn, body temperature in specific location of the body, while relaxing and while in exertion states.

SUMMARY OF THE INVENTION

It is an object of the present invention to provide a garment for boosting circulation in areas of a user's body corresponding to the user's joint articulations, comprising one or more connected fabric members that are each of a size for at least partly covering one or more parts of the user's body that include at least one joint area lying over at least one joint and adjacent areas of the user, and at least one muscle area lying over at least one large muscle of the user, each fabric member being either dimensioned or structured so as not to compress that part of the user's body that is encircled by the fabric member, the fabric member having a heat insulating property at each joint area to be covered, and a heat transmitting property at each muscle area to be covered, so that when the garment is worn, each joint area stays warmer than each muscle area, to boost circulation in each joint area, to, in turn, balance the body's use and development.

The structure and placement of the garment of the invention causes temperature increase and improvements in circulation in the joint areas of the user, by strategic placement and internal materials used in the garment and not just by increased body temperature overall, nor by compression that tends to reduce temperature and blood circulation. If FIG. 9 represents a relaxed state with the knee joint about 4.5 degrees Celsius cooler then the large muscle groups, the invention will cause the knee joint to warm to about 29.5 degrees Celsius or warmer, thus increasing circulation and temperature throughout the body but not causing over heating of the muscle areas.

A purpose of the invention is to bring heat/circulation to the areas of the joints and to decease heat in the naturally warmer areas of the muscles, to balance the circulation, protect the body against over heating and improve a user's performance.

The garment or apparel of the invention is comprised of technical fabrics placed in biomechanically calculated and selected locations on the body that correspond within the garment. The design generates heat to stimulate vasodilation in vital regions, i.e., joint articulations areas of the body. Increased heat distribution in and around joints of the periphery improves circulation and efficiency in movement and recovery.

The advantages of the invention result from creating a product that improves performance and recovery based on the physical demands of modern people and augments physical movement, expedites recovery and regeneration for an increasingly active population.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
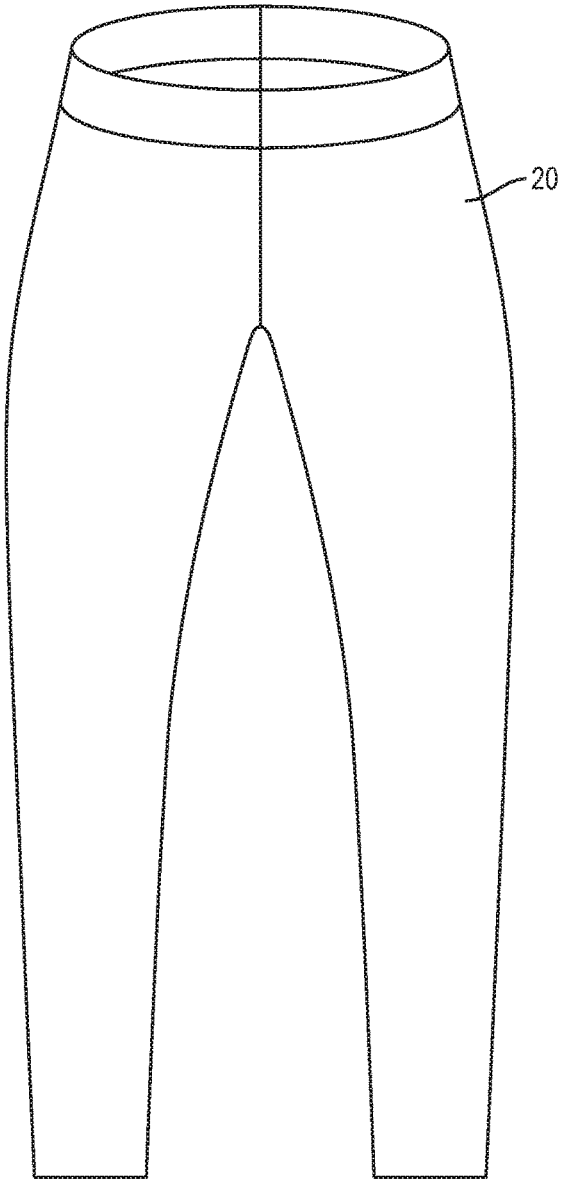
FIG. 1 is a front view of a slim-fit workout and recovery pant according to the invention, in a right-side-out position of any fabric.
Figure 2:
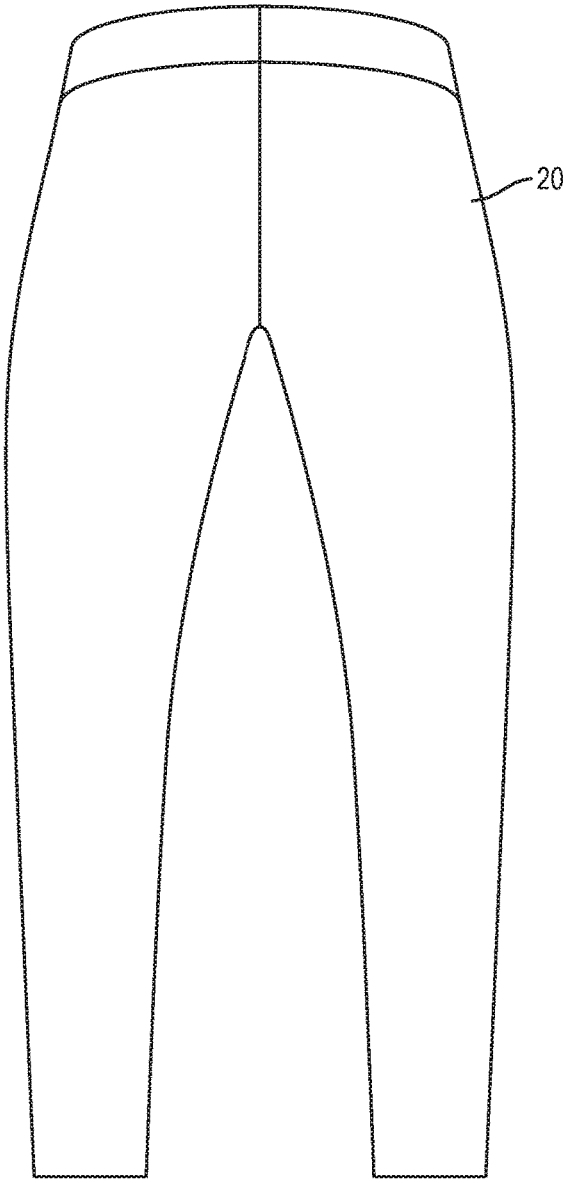
FIG. 2 is a back view of the slim-fit workout and recovery pant according to the invention, in the right-side-out position.
Figure 3:
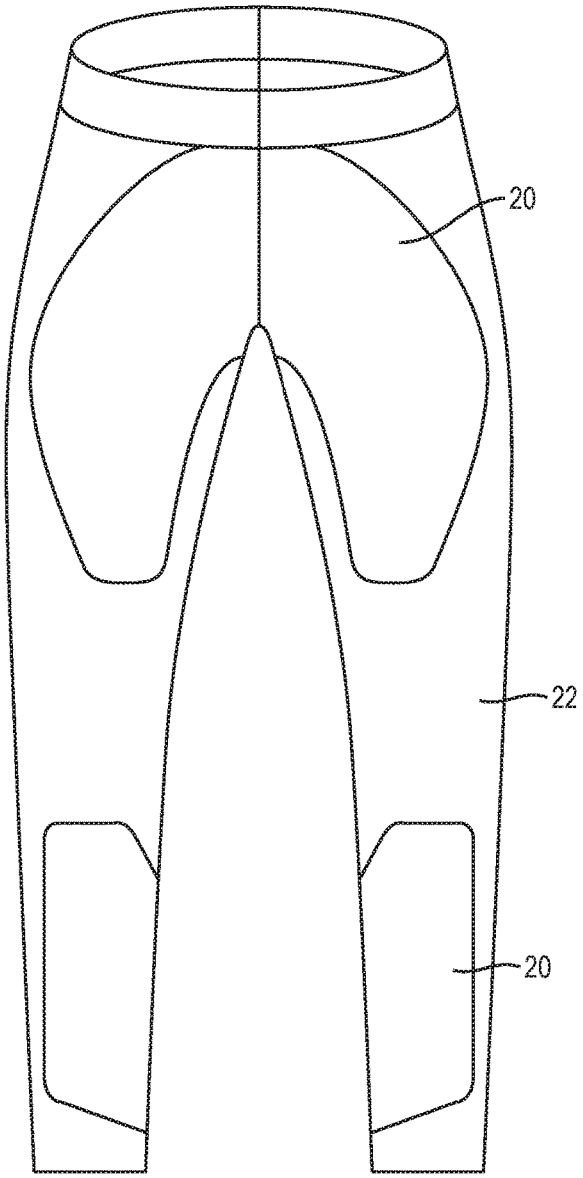
FIG. 3 is a front view of the slim-fit workout and recovery pant according to the invention, in an inside-out position which reveals parts of the heat insulating areas of the invention, such as those at the left and right hip areas, the knee joints and the ankle joints.
Figure 4:
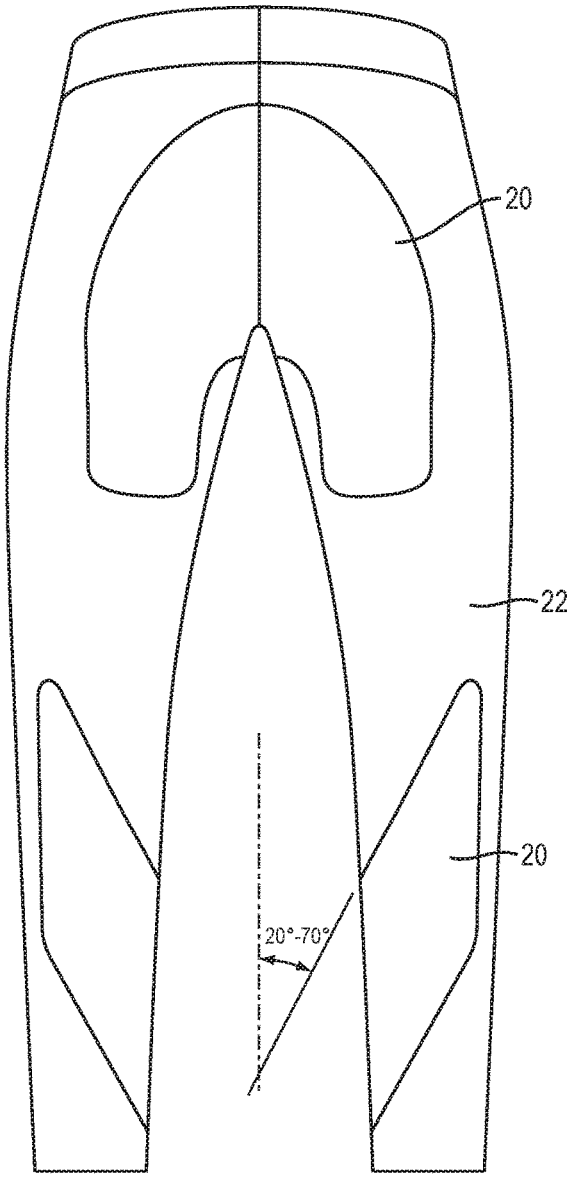
FIG. 4 is a back view of the slim-fit workout and recovery pant according to the invention, also in the inside-out position which reveals other parts of the heat insulating areas of the invention, such as those at the left and right hip areas, the knee joints, the ankle joints and the base of the spine.
Figure 5:
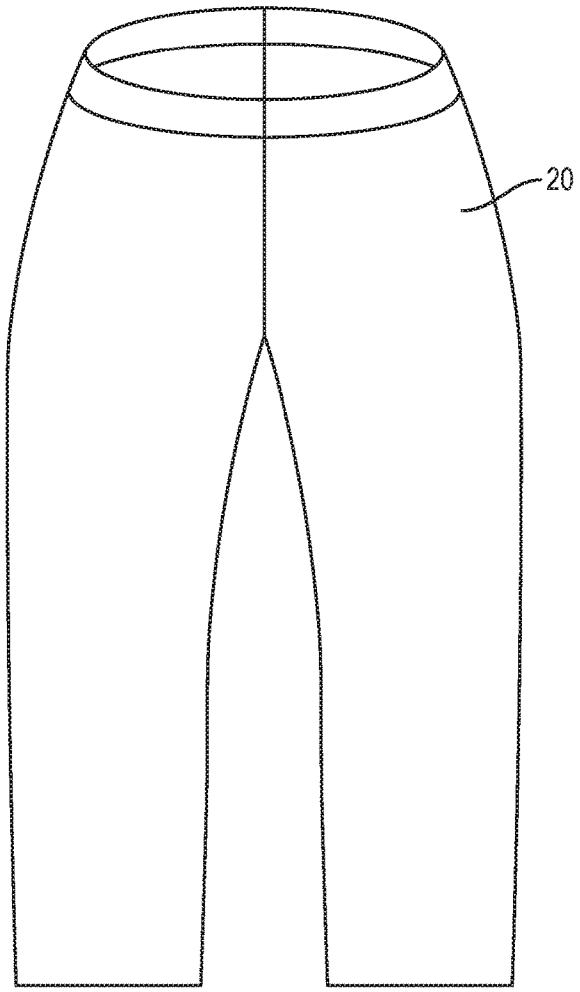
FIG. 5 is a front view of a relaxed-fit workout and recovery pant according to the invention, in the right-side-out position and of any fabric.
Figure 6:
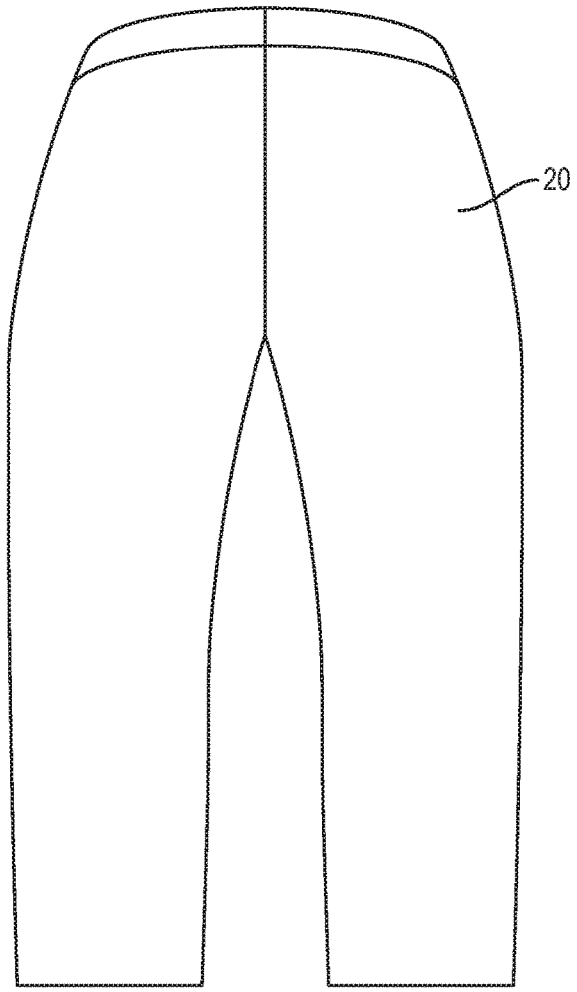
FIG. 6 is a back view of the relaxed-fit workout and recovery pant according to the invention, in the right-side-out position.
Figure 7:
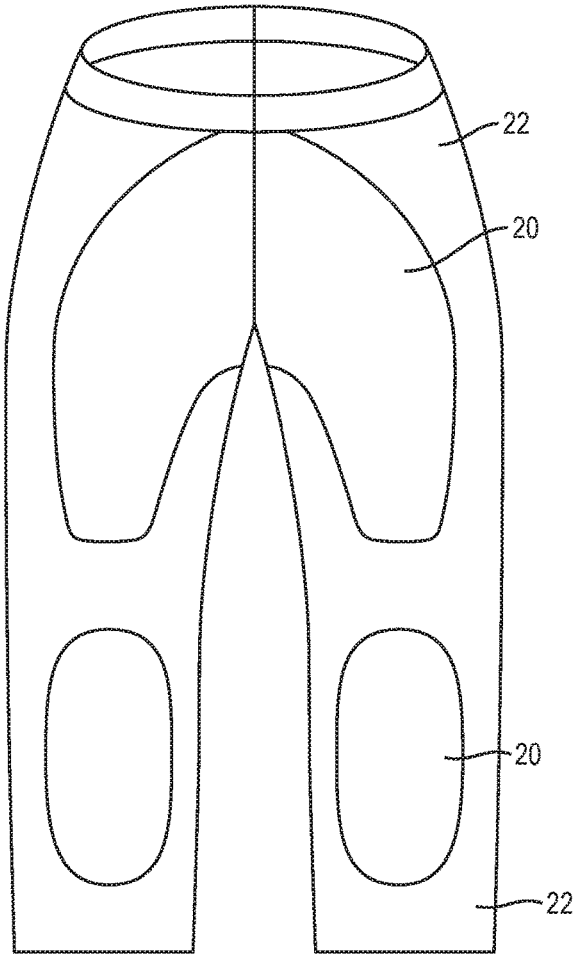
FIG. 7 is a front view of a relaxed-fit workout and recovery pant according to the invention, in an inside-out position which reveals parts of the heat insulating areas of the invention, such as those at the left and right hip areas, the knee joints and the ankle joints.
Figure 8:
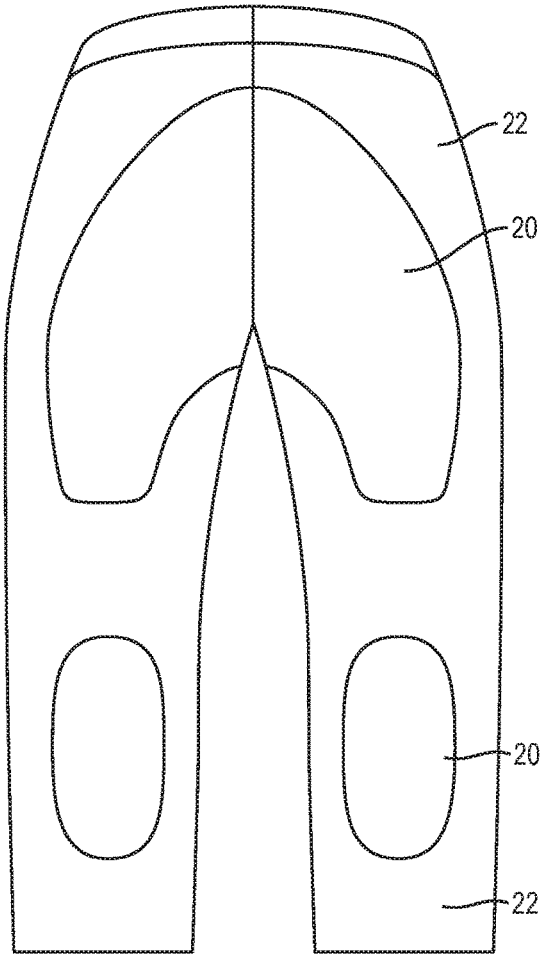
FIG. 8 is a back view of the relaxed-fit workout and recovery pant according to the invention, also in the inside-out position which reveals other parts of the heat insulating areas of the invention, such as those at the left and right hip areas, the knee joints, the ankle joints and the base of the spine.
Figure 9:
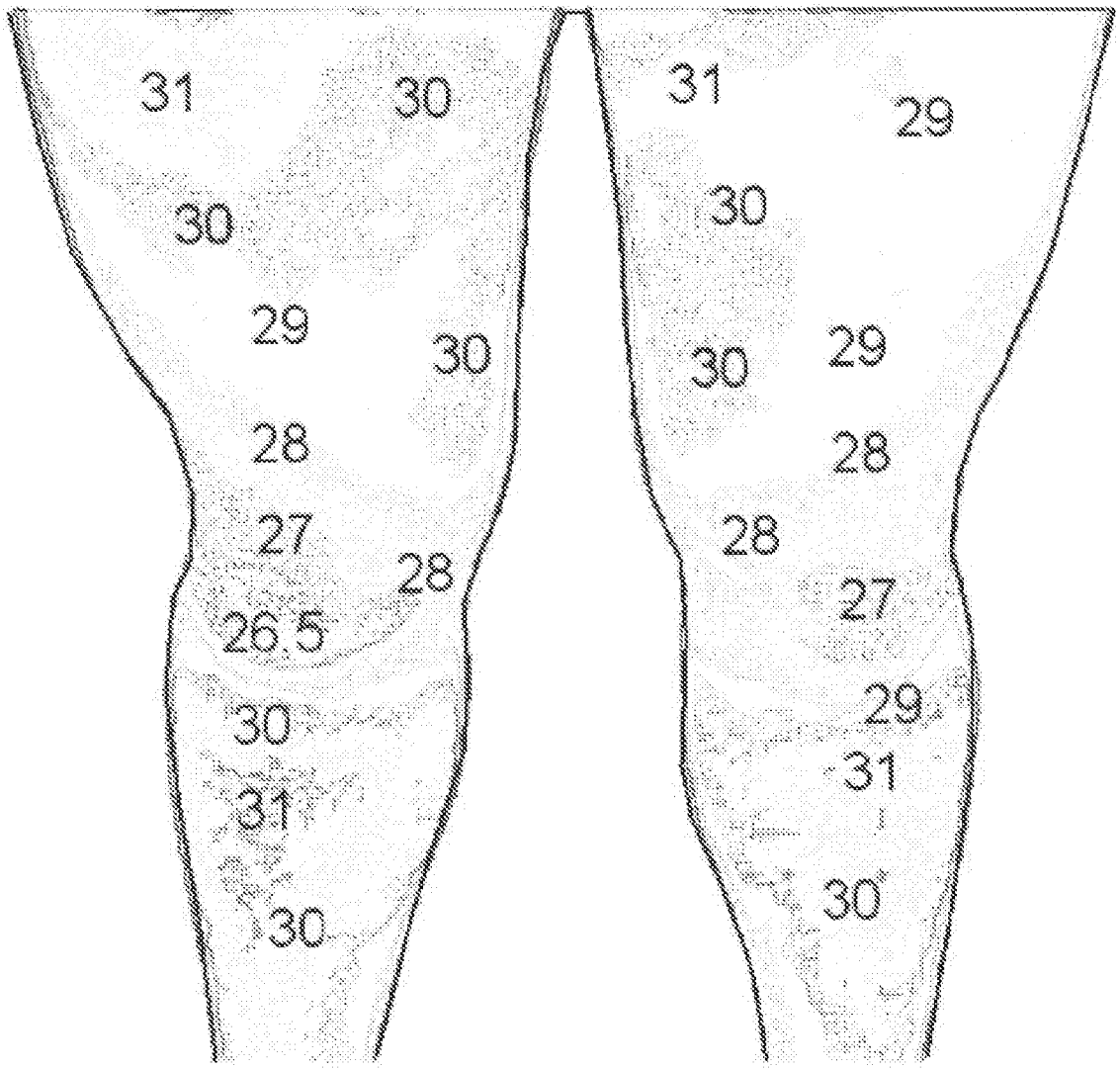
FIG. 9 is a schematic diagram of the legs of a person showing the approximate, normal, at rest temperature of the areas of the legs, including joints areas, namely the knee joints, and muscle areas above and below the knee joints, to illustrate the usual cooler temperatures in the joint areas than those in the muscle areas.

Referring now to the drawings, in which like reference numerals are used to refer to the same or similar elements, FIGS. 1 to 4 show a garment pant of the invention in the form of a slim-fit workout and recovery pant according to the invention, with base fabric 20 of heat transmitting material that extends over all of the joint and muscle areas, for covering both legs and the low hip of the user, and heat insulating fabric portions 22, fixed to the inside surfaces of the pant for covering the joint areas. The garment pant includes a part for covering the waist, the low hips and legs and the insulating layer 22 of heat insulating material covers the knees, the outer legs, the outer hips and the ankles, leaving uncovered, the gluteus maximus or buttocks, the abdominal muscles or tummy, the quadriceps and back hamstring muscles of the legs above the knees, and the inner, front and back parts of the calves, when the garment is being worn by the user, to allow for cooling of these muscle areas. Insulating layer 22 has upper and lower edges at its back part, that angle downwardly and inwardly of each leg, respectively above and below the user's calves as seen in FIG. 4. This angle is preferably about 20 to 70 degrees from the vertical axis of the pant, or more preferably about 30 to 50 degrees from the vertical.

FIGS. 5-8 show a relaxed-fit workout and recovery pant according to the invention, with analogous base and insulated fabric areas 20 and 22.

The apparel or garments of the invention may be in the form of shirts, tunics, tops, pants, shorts, vests, top-plus-pant sets and/or hooded or un-hooded pullovers or jackets, and used as active wear, such as exercise clothing, outer wear, recovery garments, undergarments, for use after an exercise session or for medical recovery, or even specialty clothing such as wet suits.

The base fabric that makes up most or all of the surface of the garment of the invention, in any of its configuration, must be more transmissive of heat than the heat insulating fabric parts to allow the heat to leave the hotter muscle areas. This may be nylon, nylon blends, cotton or other fabric that can be connected to the heat insulating fabric portions by fusing with AIR MESH or the like.

An example of the base fabric used to make the garments of the invention, is a nylon blend of knit 77% nylon threads and 23% polyurethane threads. Any knit or woven fabric with suitable head transmitting properties can be used, however. For active wear the fabric should be knit not woven, however, so there it can stretch but any active wear fabric could be used for the exterior base fabric layer.

An example of heat insulating fabric of the invention for covering, and therefore selectively warming the joint areas of a user, is known by the acronym MIYABI. The type of MIYABI fabric found best for the insulating fabric of the invention, since it has the needed stretch, is known as quality #SVQ-50-053 that comes in a width of 62 inches, and has a weight of 160 grams per square meter. The fabric was found to have good heat maintaining, stretch and movement features needed for the purpose of the invention's activewear.

For heat retention it was challenging to find a synthetic yarn that worked best but the following was found to be effective.

Carbon Black Nylon Yarn: is a nylon yarn that is dyed black and the carbon in the fiber maintains a higher temperature. The only limitation was that it can only be offered in the color black.

MIYABI: This is the fiber used for UNIQLO's HEATTECH and Marks & Spencer's HEATGEN items. The only downside is that it is not a synthetic fiber but is a staple fiber like cotton, Rayon, etc.

Another example of the heat insulating fabric is MIYABI Blend: quality #SVQ50-053, 160 gms, 42% MIYABI acrylic 24% polyester 18% viscose 6% pu.

Fusing of the heat insulating material to the heat transmissive fabric base is the technique mentioned above, known by the brand name AIR MESH and available from Debs Corporation of Japan.

For example the MIYABI fabric can be fused to the base fabric Temperature: 160C to 180C (320F to 356F).

Pressure: 3 to 4 bar; and

Time: 10 to 30 seconds.

These are standard lamination conditions which require a standard laminating facility that is widely available to the trade.

All placements were guided by a general fashion industry standard of placements for clothing all positions will grade based on industry standards for sex and size ¼" to ¾" grade rule would apply for all placements:

HPS—High point shoulder

15" down from high point shoulder is the waist

3" down from waist is high hip

8" down from waist is low hip

8" up from wrist bone is forearm 11" up from wrist bone is the elbow

Shoulder width bone to bone is 15".

These values are based on tendon length start and stop point of coverage and large muscle start and stop coverage the below mock proto types were created in a women's size small—the lines and angles changed to achieve a better balance of coverage.

While specific embodiments of the invention have been shown and described in detail to illustrate the application of the principles of the invention, it will be understood that the invention may be embodied otherwise without departing from such principles.

What is claimed is:

1. A garment for boosting circulation in areas of a user's body corresponding to the user's joints, comprising: at least one fabric member configured to at least partly cover at least one part of the user's body that includes at least one joint area lying over at least one joint of the user, and at least one muscle area lying over at least one muscle of the user; the at least one fabric member having a heat insulating property at the at least one joint area to be covered and a heat transmitting property at the at least one muscle area to be covered, so that when the garment is worn, each joint area stays warmer than each muscle area to boost circulation in each joint area wherein the garment is a pant for covering the waist, hips and less, the at least one fabric member including at least one base layer of heat transmitting material that is adapted to extend over all of the at least one joint area and the at least one muscle area, and at least one insulating layer of heat insulating material fixed to the at least one base layer and adapted to extend only over the at least one joint area, the at least one insulating layer of heat insulating material adapted to cover the knees, the outer legs, the outer hips and the ankles, leaving uncovered, the buttocks, the tummy, front and back parts of the less above the knees, and the inner, front and back parts of the caves, when the garment is being worn by the user, wherein the at least one fabric member including the at least one base layer of heat transmitting material that is adapted to extend over all of the at least one joint area and the at least one muscle area and the at east one insulating layer of heat insulating material is arranged such that the at least one insulating layer of heat insulating material is fixed to an inside surface of the at least one base layer and adapted to extend only over the at least one joint area, the at least one insulating layer having upper and lower edges for covering lower back legs of the user that extend at an angle of 20 to 70 degrees from a vertical axis of the pant.

2. The garment of claim 1, wherein the heat transmitting material consists of at least one material selected from the group of nylon, polyurethane, polyester, cotton and wool, and the heat insulating material consists of at least one material selected from the group of micro acrylic yarn, blend micro acrylic yarn blended with any other material, and acrylic.

3. The garment of claim 1, wherein the heat transmitting material and the heat insulating material are both flexible.

4. The garment of claim 1, the at least one insulating layer having upper and lower edges for covering lower back legs of the user, that extend at an angle of 30 to 50 degrees from a vertical axis of the pant.

* * * * *